US008151539B2

(12) United States Patent
Grinsted

(10) Patent No.: US 8,151,539 B2
(45) Date of Patent: Apr. 10, 2012

(54) PANEL BUILDING SYSTEM

(75) Inventor: Glenn Lawrence Grinsted, Palmwoods (AU)

(73) Assignee: Constructions Systems Australia Pty Ltd, Surfers Paradise, Queensland (AU)

( * ) Notice: Subject to any disclaimer, the term of this patent is extended or adjusted under 35 U.S.C. 154(b) by 0 days.

(21) Appl. No.: 12/672,325

(22) PCT Filed: May 29, 2008

(86) PCT No.: PCT/AU2008/000765

§ 371 (c)(1),
(2), (4) Date: Feb. 5, 2010

(87) PCT Pub. No.: WO2009/021264

PCT Pub. Date: Feb. 19, 2009

(65) Prior Publication Data

US 2011/0067331 A1 Mar. 24, 2011

(30) Foreign Application Priority Data

Aug. 10, 2007 (AU) ..... 2007904307

(51) Int. Cl.
*E04B 1/00* (2006.01)

(52) U.S. Cl. ..... 52/745.1; 52/220.2; 52/309.7; 52/309.8

(58) Field of Classification Search ..... 52/220.2, 52/281, 284, 286, 309.2, 309.7, 309.4, 309.8, 52/309.12, 309.14, 309.16, 309.17, 794.1, 52/745.1; 403/401

See application file for complete search history.

(56) References Cited

U.S. PATENT DOCUMENTS 4,154,030 A * 5/1979 Huguet ..... 52/98
4,567,699 A * 2/1986 McClellan ..... 52/127.7
5,088,260 A * 2/1992 Barton et al. ..... 52/416
5,279,089 A * 1/1994 Gulur ..... 52/309.11
5,377,470 A * 1/1995 Hebinck ..... 52/405.1
5,519,971 A * 5/1996 Ramirez ..... 52/220.2
5,638,651 A * 6/1997 Ford ..... 52/309.7
5,701,708 A * 12/1997 Taraba et al. ..... 52/309.9
5,771,645 A * 6/1998 Porter ..... 52/220.2
5,822,940 A 10/1998 Carlin et al.
5,842,276 A 12/1998 Asher et al.
6,044,603 A * 4/2000 Bader ..... 52/309.7
6,282,853 B1 * 9/2001 Blaney et al. ..... 52/223.7
6,463,702 B1 * 10/2002 Weaver et al. ..... 52/79.1
6,481,172 B1 11/2002 Porter (Continued)

FOREIGN PATENT DOCUMENTS

AU 452043 8/1974

(Continued)

*Primary Examiner* — William Gilbert
*Assistant Examiner* — Gisele Ford
(74) *Attorney, Agent, or Firm* — Shoemaker and Mattare

(57) ABSTRACT

The present invention is directed to a prefabricated panel and panel building system for use in construction of houses. The prefabricated building panel has a foam body with one or more apertures in which to position one or more studs or noggins, one or more channels in the upper and lower end walls to locate about top and bottom track members respectively, and side end walls that are shaped to join to adjacent panels. The panel is located and attached to the track members to cover the track members and the one or more studs or noggins members are positioned and substantially enclosed in the one or more apertures to provide a structurally integral panel for a building structure.

19 Claims, 9 Drawing Sheets

U.S. PATENT DOCUMENTS

| | | | |
|---|---|---|---|
| 2007/0163197 | A1 | 7/2007 | Payne et al. |

FOREIGN PATENT DOCUMENTS

| | | |
|---|---|---|
| AU | 577072 | 9/1988 |
| WO | 93/06316 | 4/1993 |
| WO | 97/44544 | 11/1997 |
| WO | 2006/011818 | 2/2006 |

* cited by examiner

PANEL BUILDING SYSTEM

FIELD OF INVENTION

The present invention relates to building products and buildings. The present invention has particular but not exclusive application for the construction of walls for buildings. Reference to buildings in the specification includes houses, apartments and other dwellings as well as shops, warehouses, factories, offices and other building structures. In the specification the invention is described with reference to houses and walls of houses, but this is by way of example only and the invention is not limited to this example.

BACKGROUND OF THE INVENTION

The construction of houses typically involves the laying of a foundation, the construction of a steel or timber stud frame, layering of insulation material, laying a brick veneer or other outer wall treatment to form the external wall and the fixing of plasterboard sheeting on the frame to form the internal wall. Plasters, masonry tradesman and painters are required to finish the walls. As different tradesman perform different jobs the construction of walls for a house is often slow and labour intensive.

A number of prefabricated walls have been developed to address this problem. In U.S. Pat. No. 4,567,699 there is described a prefabricated panel and building system where each panel is formed with at least one load bearing tube and slots in the upper and lower end walls to receive a T-shaped bearer. The load bearing tube is longer than the length of the panel in order to transfer load forces. A composite wall panel is described in U.S. Pat. No. 5,822,940 where the panel comprises a polymer foam body with a light metal gauge hollow stud extending the length of the body. The panel is the width of the stud and the side wall of the stud forms a wall surface of the body. The panel fits within floor and ceiling track sections to fix the panel in position. Another structural wall panel is described in U.S. Pat. No. 6,481,172. This panel has a foam inner core sandwiched between plastic paper sheets. The internal surface can also have a further gypsum or cement composite layer to provide a finished surface. Each panel is made with compression struts to accommodate axial loading on the panel. The side end walls are recessed in order to overlap and connect to a vertical wooden stud. A further prefabricated panel is described in US 2007/0163197. The panel described in US 2007/0163197 has a plurality of vertically disposed channel-shaped metal studs equidistantly disposed between a bottom and top plate and rigid foam inserts between the studs. There are apertures in the foam inserts to provide for electrical and plumbing connections. Each panel has recessed side end walls and adjacent panels are joined by the positioning of a rigid foam spline between adjacent side end walls so that the spline fits within the opposing recesses and causes the adjacent panels to abut.

Each of the described prefabricated panels includes one or more studs within the panel during manufacture. This feature adds to the complexity of their manufacture and presents problems during transport and on-site storage. Furthermore the structural integrity of the prefabricated panel is largely fixed during manufacture and additional studs cannot be added or excess studs removed when desired.

OBJECT OF THE INVENTION

It is an object of the present invention to provide an alternative prefabricated panel and panel building system that overcomes at least in part one or more of the above mentioned disadvantages.

SUMMARY OF THE INVENTION

In one aspect the present invention broadly resides in a prefabricated building panel including a foam body with one or more apertures for positioning one or more structural members during installation to provide structural integrity, one or more channels in the upper and lower end walls for positioning relative to top and bottom track members respectively and side end walls shaped for joining to another panel.

In another aspect the present invention broadly resides in a prefabricated building panel having a foam body with one or more apertures in which to position one or more structural members, one or more channels in the upper and lower end walls to locate about top and bottom track members respectively, and side end walls that are shaped to join to adjacent panels; wherein in use the panel is located and attached to the track members to cover the track members and the one or more structural members are positioned and substantially enclosed in the one or more apertures to provide a structurally integral panel for a building structure.

In a further aspect the present invention broadly resides in a prefabricated building panel including a foam body having one or more apertures, one or more channels in the upper and lower end walls to locate about top and bottom track members, and a plurality of slots or a channel or a protrusion formed in each side end wall; the surface portion adjacent each of the side end walls on one or both sides of the foam body is chamfered;

one or more structural members each of which are positionable in one of the one or more apertures to provide structural integrity;

wherein in use the one or more structural members are positioned and substantially enclosed within the foam body to form the building panel, the building panel is locatable on the top and bottom track members and engageable with adjacent building panels by complementary or flush side end wall configurations; wherein the chamfered surface portions on adjacent building panels allows a flush and continuous finish to be formed when the panels are joined.

The foam body is preferably polystyrene, polyisocyanurate or other suitable plastics material. The foam body is preferably a single foam piece. In an alternative embodiment, the foam body can be formed from a plurality of smaller panels. The foam body preferably includes a fire retardant. The foam body can be of any suitable thickness, but in one preferment the foam body is 100 mm thick. The foam body can be of any suitable length and width.

The foam body preferably has an additional layer on one or both outer faces. The foam body preferably has a liner board layer on the internal face. The foam body preferably has a cement layer on the outside face. In another preferred embodiment the foam body has a layer of fiberglass mesh embedded in a cement polymer render on the outside face.

Preferably the surface of the internal face of the panel has a chamfered longitudinal edge to enable a plaster finish when the panels are joined. More preferably there are two chamfered longitudinal edges on the surface of the internal face of the panel.

In a preferred embodiment both the internal face and outside face of the building panel have chamfered longitudinal side edges whereby the chamfered longitudinal side edges enable a plaster finish for the internal face and a cement render finish for the outside face of the panel so to provide a continuous finish with adjacent building panels.

The foam body preferably has one or more apertures for the structural members extending between the upper and lower end walls. Preferably there are one or more apertures for the structural members extending partway or fully across the width of the foam body.

The foam body preferably has additional access apertures or grooves in the apertures for the structural members for electrical wiring and plumbing pipes and connections. In a preferred embodiment there is a semicircular groove within an aperture for a structural member.

The structural members are positioned within the panel during the construction and erection of the panels. The number of structural members positioned within a panel preferably varies depending on the use of the panel. Preferably load bearing panels will have more structural members than non-structural panels that merely partition space.

The structural members preferably include studs. In a preferred embodiment the structural members are studs and noggins. Where studs and noggins are used the noggins preferably attach to the studs.

The structural members are preferably made of metal or wood. In one preferred embodiment the structural members are metal U or Z sections.

Where the structural members include studs, the studs preferably extend between the upper and lower end walls. In a preferred embodiment where the structural members are studs, they also serve as tie downs to secure the panel to the top and bottom track members or adjacent structures.

The side end walls are preferably shaped to join to adjacent panels by having a recess in one side end wall and a complementary protrusion extending from the other side end wall. In a preferred embodiment the complementary protrusion or recess has a metal cover to protect the shape and maintain thermal insulation properties. Therefore with this arrangement, two panels can preferably join when the protrusion of one panel fits within the channel of the adjacent panel.

Alternatively both side end walls in a panel preferably have a recess so that a stud or joiner member can fit within the recesses of adjacent panels and thereby enable the adjacent panels to be joined and substantially abut each other.

The one or more channels in the upper and lower end walls preferably enables locating the panel with the respective track members. Preferably the panel is secured by means of fasteners. Positioned structural members may be used to enable tie down of the panel to the track members.

Preferably the one or more channels in the upper are similar to the one or more channels in the lower end wall enabling the panel to be inverted for purposes of locating and securing.

Where the track member is a rectangular convex section, there is preferably a single channel in the upper or lower end wall. Where the track member is a U shaped section, there are preferably two channels to accommodate the outwardly extending flanges of the U shaped section.

The track members are preferably either a rectangular section timber joist or a U shaped metal section.

Preferably adjacent corner building panels each have a mitered longitudinal side edge to form a structural corner. More preferably each mitered end wall is angled at substantially 45 degrees. In a preferred embodiment, two C-shaped structural members are joined so that outward extending flanges of the C-shaped structural members are locatable in adjacent corner building panels so that the corner panels are joined and a structural corner is formed. The two C-shaped structural members are preferably joined by a plurality of fasteners.

In a further aspect the present invention broadly resides in a panel building system including a frame with bottom track members, a plurality of panels as described above, a plurality of structural members for positioning in the panels during construction, and top track members.

The panel building system can be used to erect walls, lintels and similar structures.

The panels can form modular units to construct a wall or the like. Alternatively the panels can be customized to different thicknesses, heights and widths to suit a particular situation.

In another aspect the invention broadly resides in a method of construction using the abovementioned panels including locating bottom track members on a base;

positioning one or more panels over the bottom track members;

joining adjacent panels;

positioning one or more structural members within each of the panels to provide suitable structural integrity; and locating top track members with the panel so that the top track member is substantially covered.

The securing of the panels preferably occurs with or subsequent to the locating and positioning steps.

The system and method of construction may be used to construct a house or other type of dwelling, offices, buildings or other similar structures.

BRIEF DESCRIPTION OF THE DRAWINGS

In order that the present invention can be more readily understood reference will now be made to the accompanying drawings which illustrate a preferred embodiments of the invention and wherein.

DETAILED DESCRIPTION OF THE PREFERRED EMBODIMENTS

Figure 1:
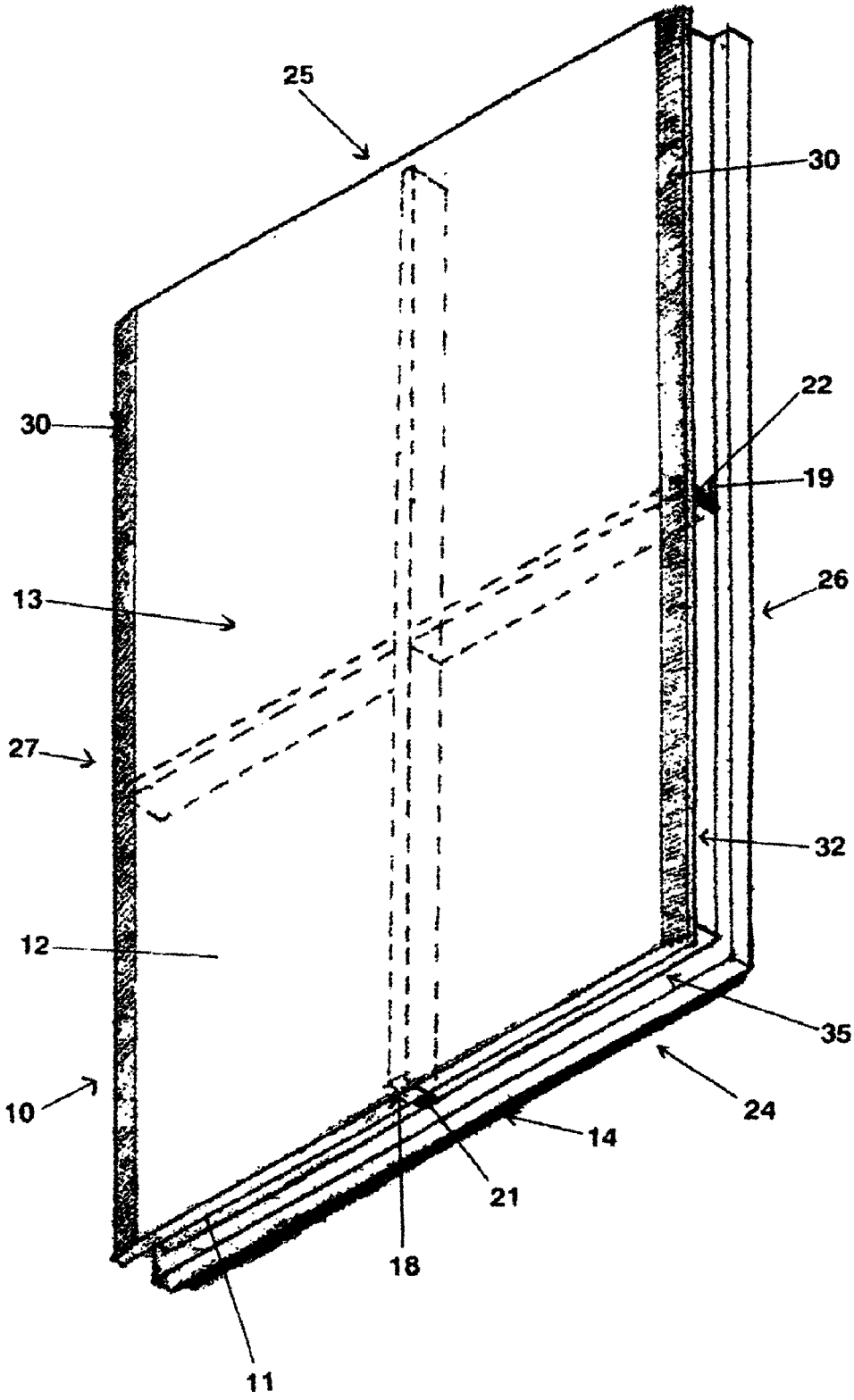
FIG. 1 is a diagrammatic view of a prefabricated panel for timber studs and timber tracking members, being a first embodiment of the invention. The panel is shown with the internal face uppermost.
Figure 2:
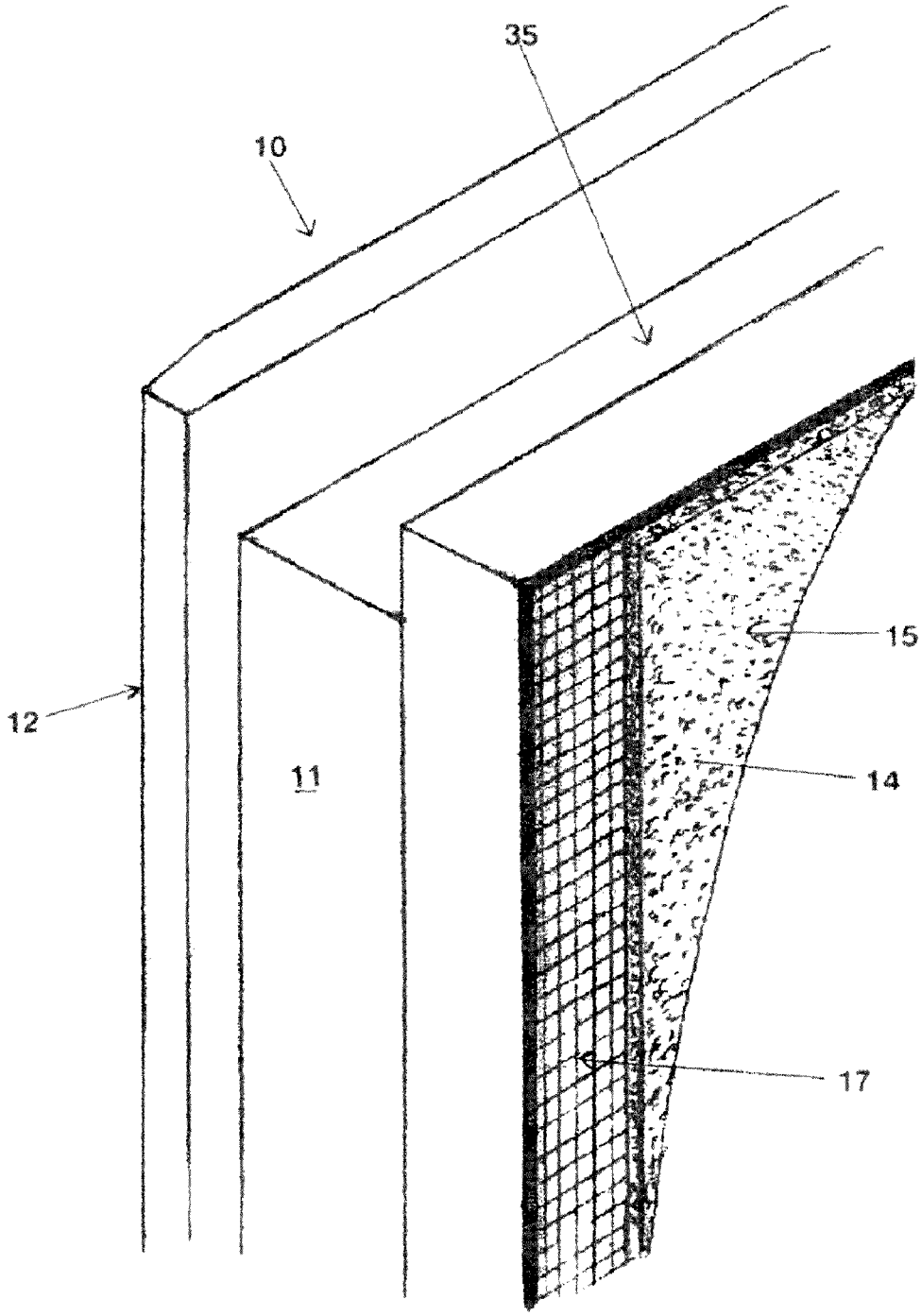
FIG. 2 is a diagrammatic cut-away view of part of the panel shown in FIG. 1.
Figure 3:
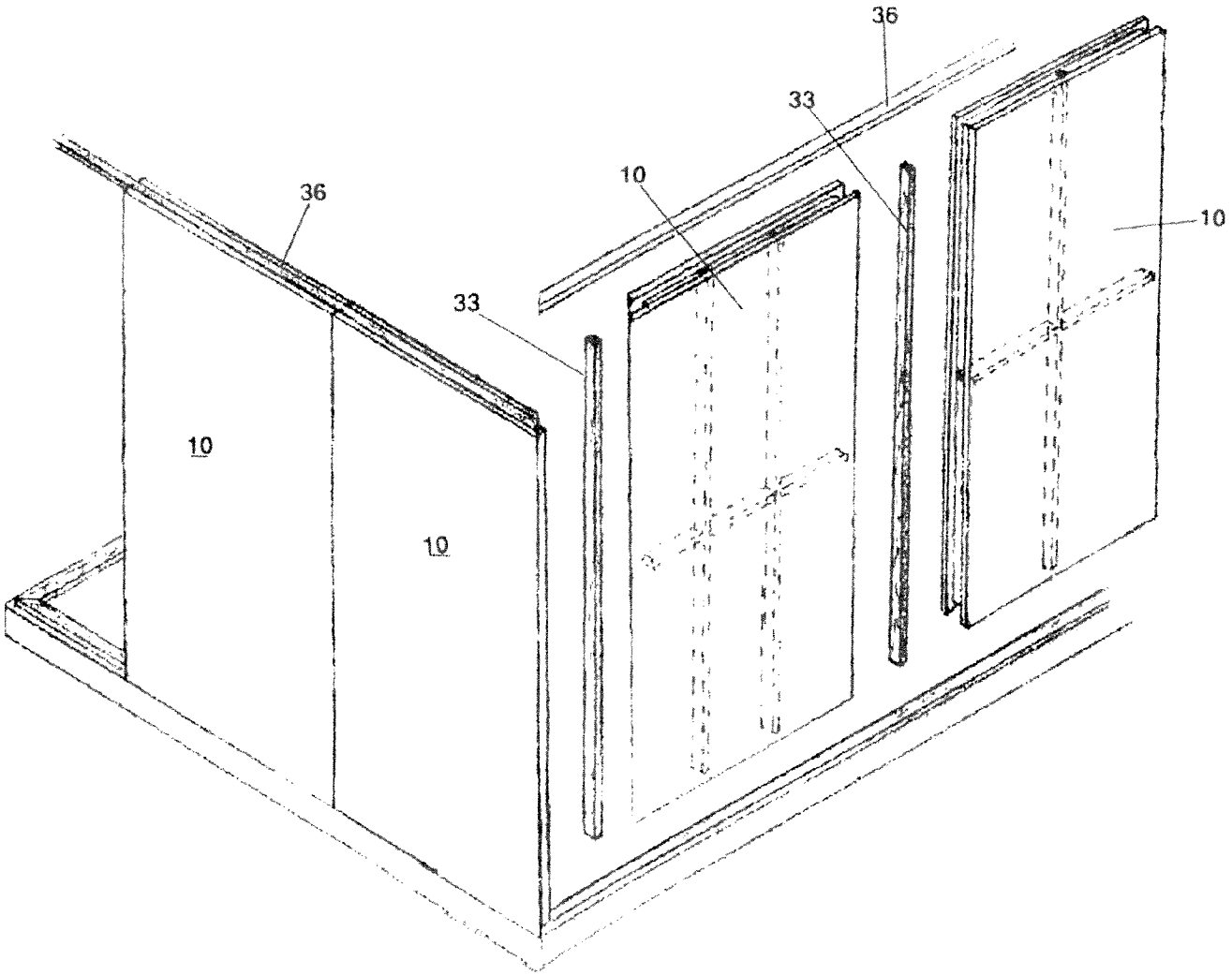
FIG. 3 is a diagrammatic view of the construction of a wall with the panel shown in FIG. 1.

With reference to FIGS. 1 to 5, there is shown a first embodiment of the prefabricated panel 10. The prefabricated panel 10 has a polystyrene foam body 11 with a laminated liner board sheeting 12 on the internal face 13 and cement rendering 14 on the outward face 15. The cement rendering 14 is embedded with a reinforcing fiberglass mesh 17.

The panel 10 is approximately 100 mm thick, 2400 mm in length and 1200 mm wide. The dimensions of the panel 10 can change as well as the number of apertures for studs and noggins.

The prefabricated panel 10 has an aperture 18 extending the length of the panel 10 and an aperture 19 extending the width of the panel 10. The aperture 18 serves to accommodate a timber stud 21. The timber stud 21 is inserted from the upper or lower end walls 24, 25 respectively. The aperture 19 serves to accommodate timber noggins 22. The timber noggins 22 are placed in position by insertion from either side end walls 26, 27. The timber noggins 22 are attached to the timber stud 21 after the timber stud 21 and timber noggins 22 are positioned within the panel 10. The placement of the timber stud 21 and timber noggins 22 provide the panel 10 with a degree of strength and integrity to withstand load bearing forces. Where the panel 10 does not require structural strength and integrity the timber studs 21 and timber noggins 22 need not be positioned within the panel 10. In this way the panel 10 can be used in a variety of structural or non-structural situations and structural integrity can be increased by the placement of studs or studs and noggins on site when needed.

Figure 4:
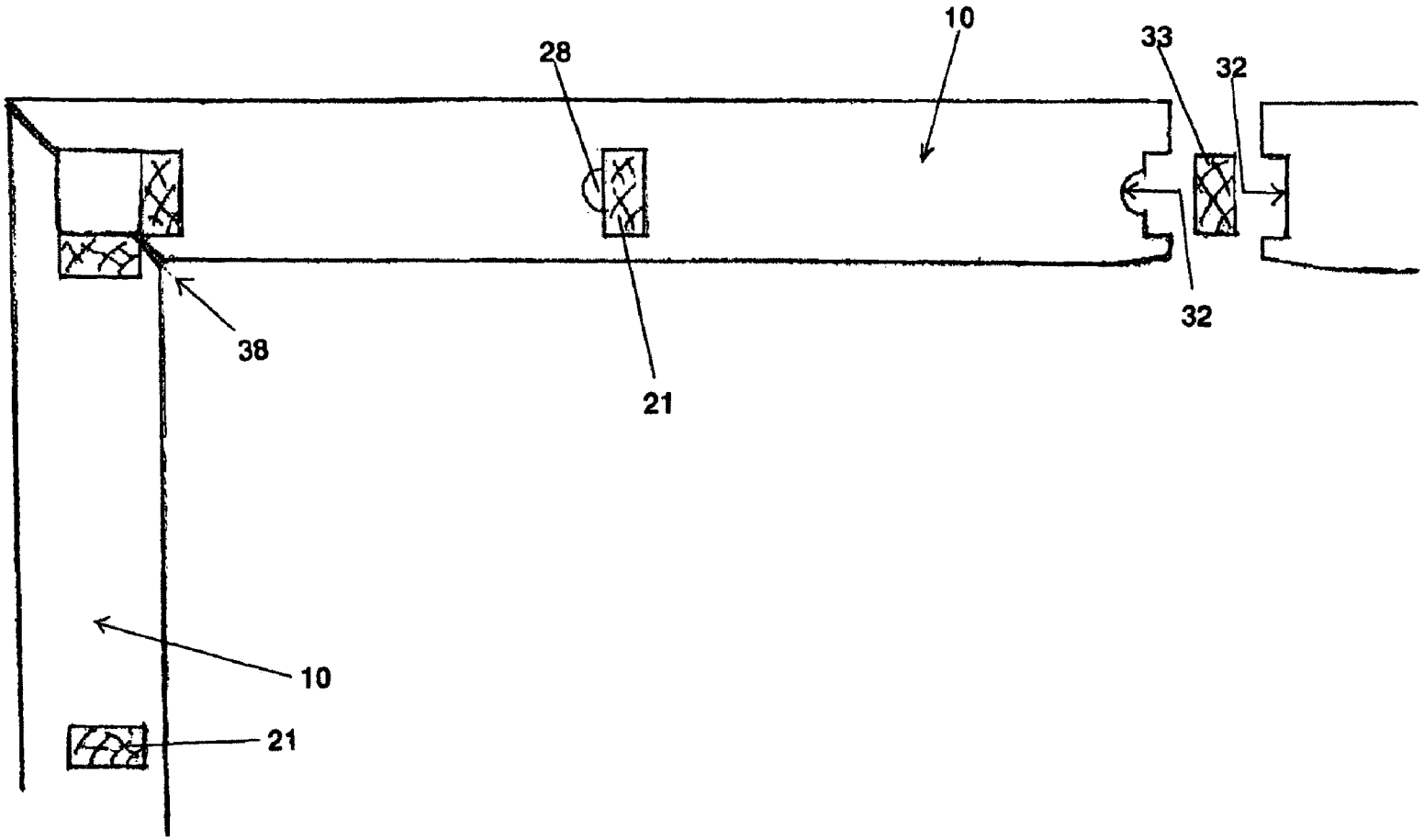
FIG. 4 is a cross-sectional view of the construction of the wall using the panel shown in FIG. 1.
Figure 5:
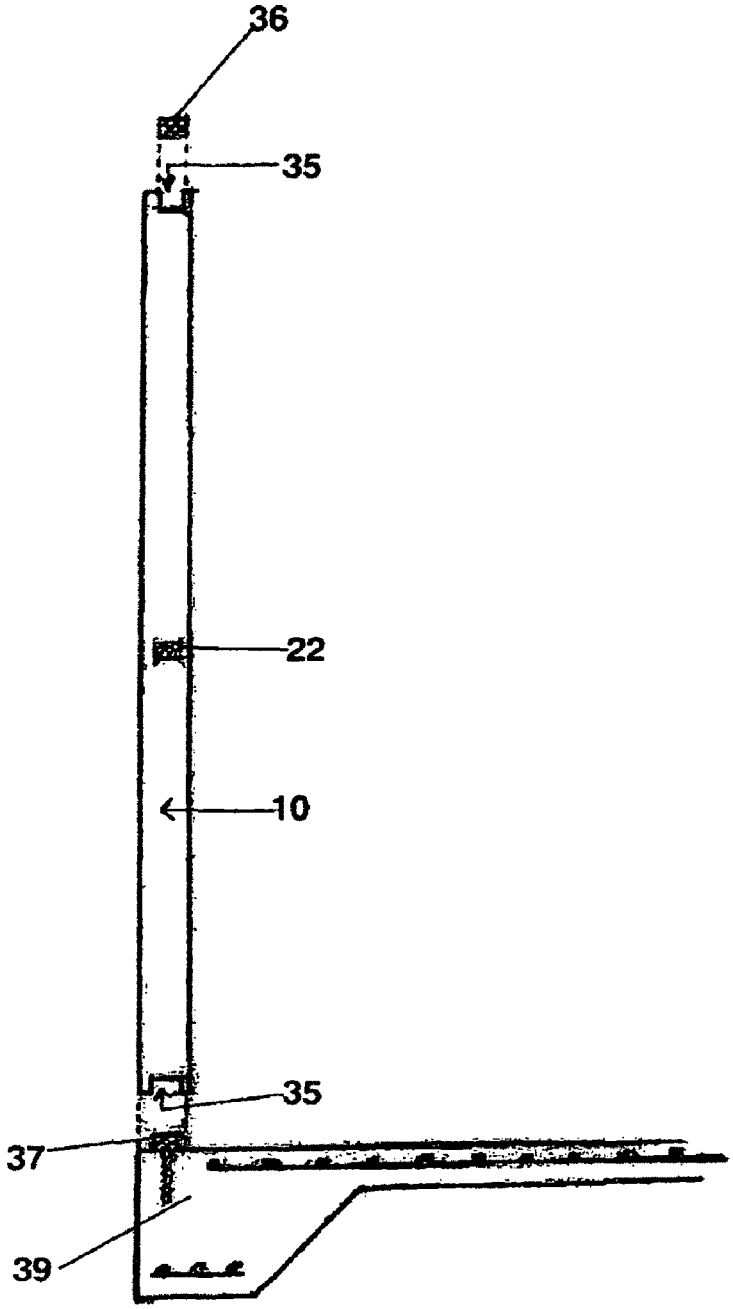
FIG. 5 is a sectional elevation view of the construction of a wall using the panel shown in FIG. 1.
Figure 6:
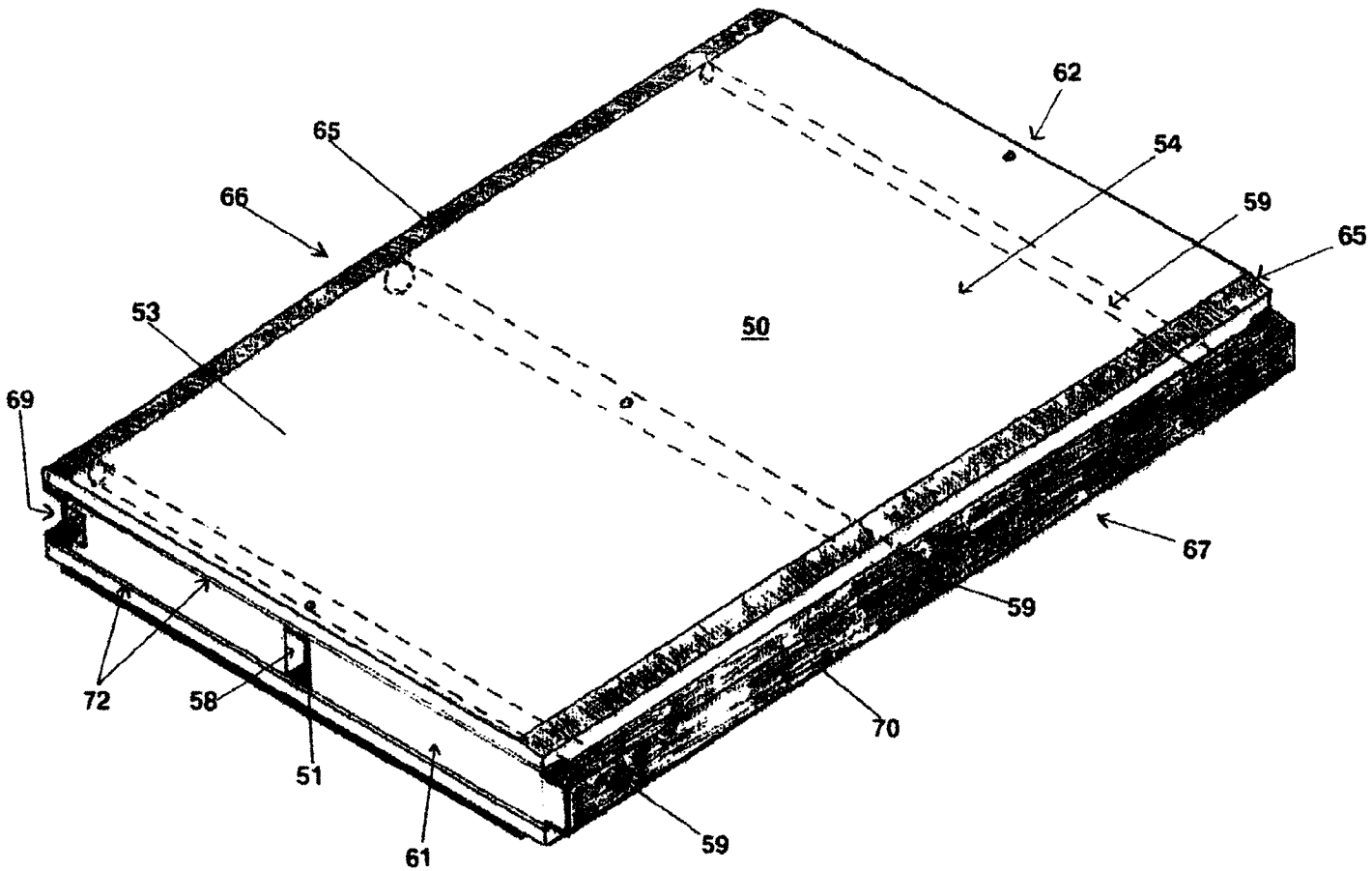
FIG. 6 is a diagrammatic view of a prefabricated panel for metal studs and metal tracking members, being a second embodiment of the invention. The panel is shown with the internal face uppermost.
Figure 7:
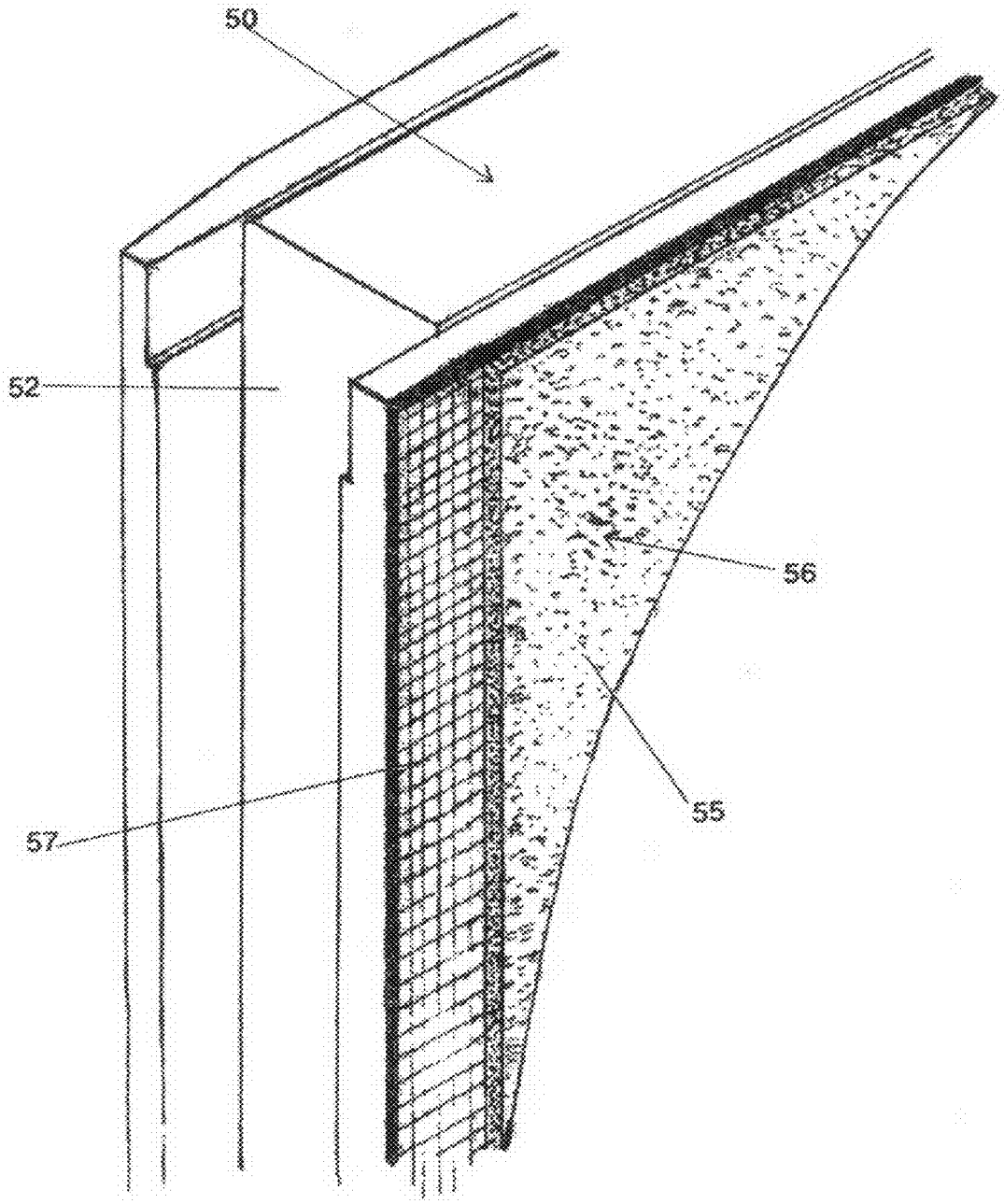
FIG. 7 is a diagrammatic cut-away view of the part of the panel shown in FIG. 6.
Figure 8:
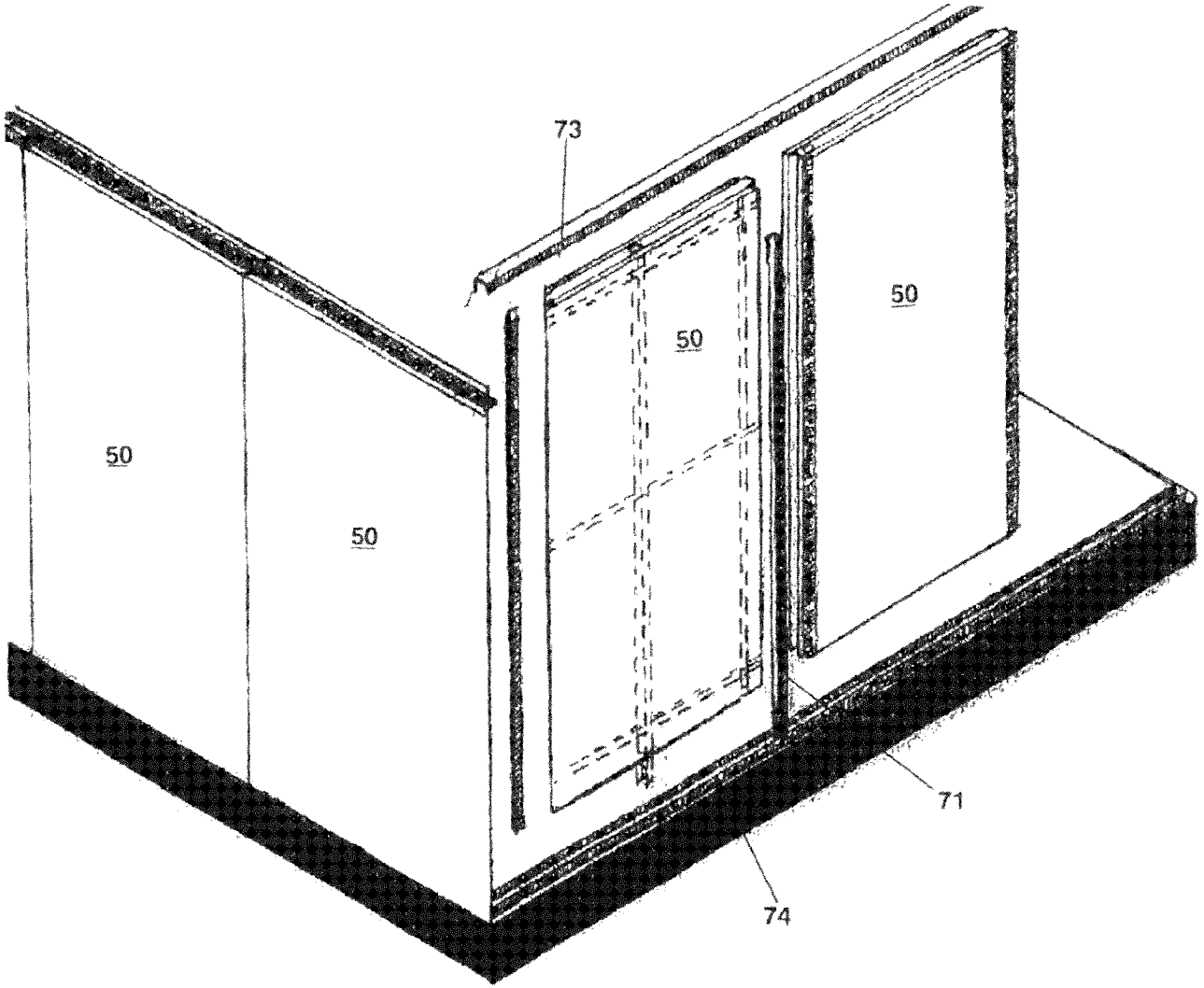
FIG. 8 is a diagrammatic view of the construction of a wall with the panel shown in FIG. 6.
Figure 9:
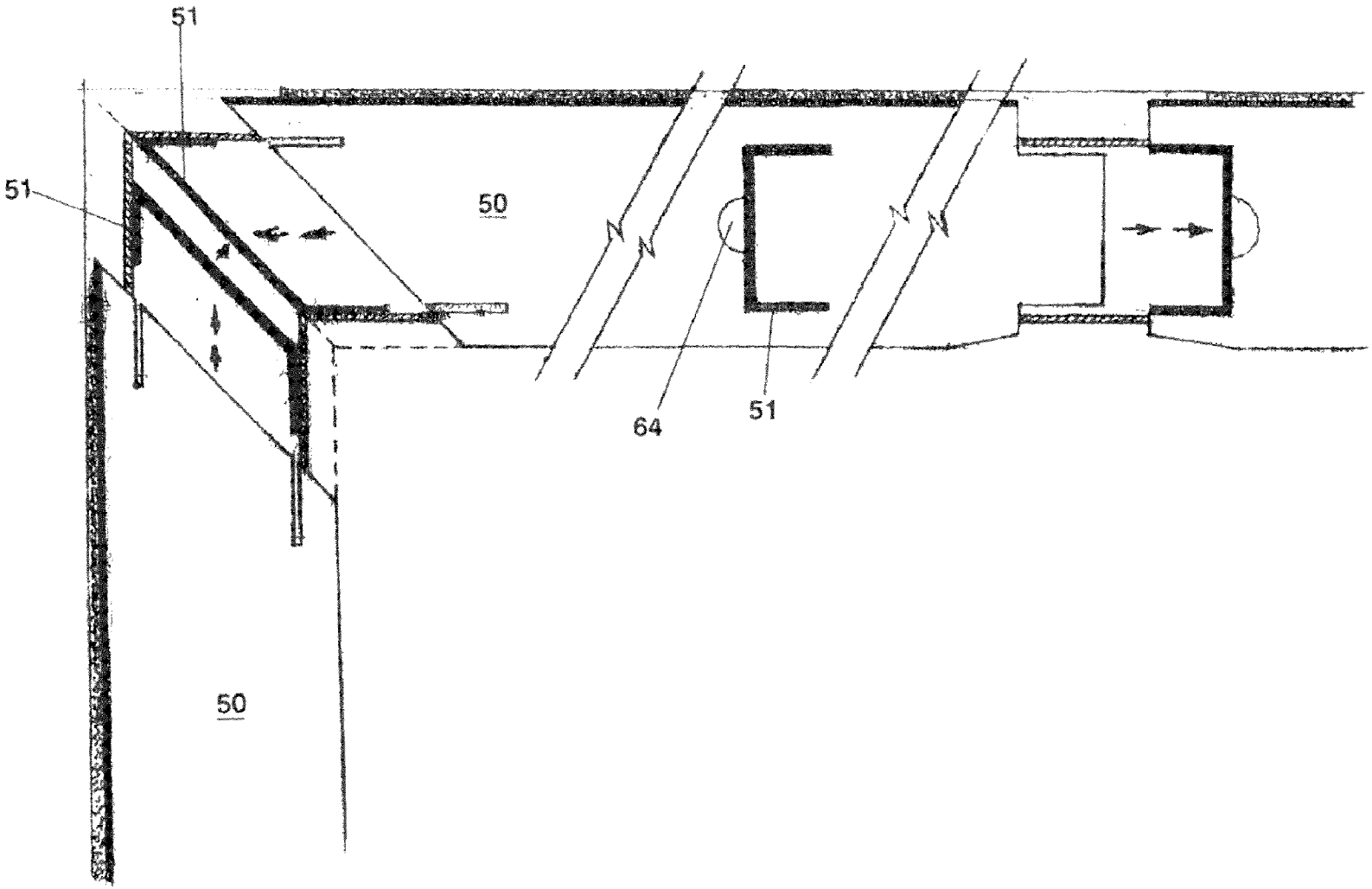
FIG. 9 is a cross-sectional view of the construction of the wall using the panel shown in FIG. 6.

With particular reference to FIG. 4 there is shown a semi-circular groove 28 within the aperture 18. The semi-circular groove 28 enables electrical wiring and/or plumbing pipes and connections to pass into and through the panel 10.

The internal face 13 of the panel 10 has chamfered longitudinal edges 30 adjacent the side end walls 26, 27. The chamfered longitudinal edges 30 allow a plasterer to lay a plaster joining strip over the chamfered longitudinal edges 30 when two panels 10 are joined and produce a plaster finish so that the join is unnoticeable.

The side end walls 26, 27 have a channel 32. Two adjacent panels 10 have opposing channels 32 and a timber stud 33 can be positioned there-between to join the two adjacent panels 10. The timber stud 33 has a width that is approximately twice the depth of the channels 32.

The upper end wall 24 and lower end wall 25 have channels 35. A timber top tracking member 36 can fit within the channel 35 of the upper end wall 24 to locate the panel 10 relative to a ceiling (or joist). Similarly, a timber bottom tracking member 37 can fit within the channel 35 of the lower end wall 25 to locate the panel 10 relative to a floor 39 (or foundation). After the panel 10 has been located relative to the tracking members 36, 37, and relative to adjacent panels, the panel 10 can be secured in position with fasteners along the upper, lower and side edges of the panel 10. Where a timber stud 21 has been inserted in the panel 10, a tie-down bracket (not shown) can be placed under the bottom tracking member 37 and fastened to either side of the timber stud 21. In a similar manner, a tie-down bracket (not shown) attached to the top tracking member 36, can be fastened to the timber stud 21. The use of tie-brackets further secures the position of the panel 10 relative to the tracking members 36, 37.

Where two panels 10 form a corner, the abutting edges have a 45 degree mitre and the abutting edges are joined by a conventional three-stud corner 38. (There are recesses in the foam bodies to receive the studs.) With reference to FIGS. 6 to 9, there is shown a second embodiment of the invention being a panel 50 using U-section metal studs 51. Similar to the first embodiment, the panel 50 has a foam body 52 with a laminated liner board sheeting 53 on the internal face 54 and cement rendering 55 on the outward face 56. The cement rendering 55 is embedded with a reinforcing fiberglass mesh 57.

The dimensions of the panel 50 are similar to the dimensions of the panel 10. As well, panel 50 can vary in its size and number of apertures.

The prefabricated panel 50 has an aperture 58 extending the length of the panel 50 and three apertures 59 extending the width of the panel 50. The aperture 58 can accommodate a U-shaped metal stud 51. The U-shaped metal stud 51 is inserted from the upper or lower end walls 61, 62 respectively. The three apertures 59 can accommodate U-shaped metal noggins (not shown). The U-shaped metal noggins are fastenable to the U-shaped metal stud 51. The placement of the U-shaped metal stud 51 and U-shaped metal noggins provide the panel 50 with a degree of strength and integrity to withstand load bearing forces. Where the panel 50 does not require structural strength and integrity the U-shaped metal studs 51 and U-shaped metal noggins need not be positioned within the panel 50. In this way the panel 50 can be used in a variety of structural or non-structural situations and structural integrity can be increased by the placement of studs or studs and noggins on site when needed.

There is also shown a semi-circular groove 64 within the aperture 58. The semi-circular groove 64 provides access for electrical wiring and/or plumbing pipes and connections to pass into and through the panel 50.

The internal face 54 of the panel 50 has chamfered longitudinal edges 65 adjacent the side end walls 66, 67. The chamfered longitudinal edges 65 allows a plasterer to lay a joining strip over the chamfered longitudinal edges 65 when two panels 50 are joined to produce a plaster finish so that the join is unnoticeable.

The side end wall 66 has a channel 69 while the side end wall 67 has a complementary protrusion 70. Two adjacent panels are joined when the protrusion 70 of one panel fits within the channel 69 of the other panel. The protrusion 70 has a metal cover 71 to protect and maintain its shape and align electrical wire access apertures between panels.

The upper end wall 61 and lower end wall 62 each have two channels 72. Because both end walls 61, 62 are similar, the panel 50 can be inverted to effect joining of two panels. That is, a panel can be inverted so that one panel has a channel 69 and the other panel has an opposing protrusion 70. A U-shaped metal top tracking member 73 can fit into the channel 72 of the upper end wall 61 to locate the panel 50 relative to a ceiling (or joist). Similarly, a U-shaped metal bottom tracking member 74 can fit into the channel 72 of the lower end wall 62 to locate the panel 50 relative to a floor (or foundation). After the panel 50 has been located relative to the tracking members 73, 74, and relative to adjacent panels, the panel 50 can be secured in position with fasteners along the upper, lower and side edges of the panel 50.

The U-shaped metal stud 51 can be fastened to the top tracking member 73 and the bottom tracking member 74. The bottom tracking member 74 is chemset anchored to a concrete floor or bolted to a raised floor.

The panels 50 have a 45 degree mitre in order to join and form a corner. At the corner, each panel 50 has a U-shaped metal stud 51 positioned at its mitred end to provide strength and integrity to the corner.

Panels 10 and 50 can be used to construct walls, lintels and other similar structures in a modular-type panel building system. During the construction of the buildings, different panels may have different numbers of studs and/or studs and noggins to suit the structural requirements for the panel. Different sized panels can also be used when required.

ADVANTAGES

The advantages of the present invention include constructing a house or building in a reduced amount of time compared with traditional methods. The prefabricated panels can be structurally strengthened with the insertion of studs and studs and noggins onsite. The ability to structurally strengthen prefabricated panels onsite to the level required provides a versatility to prefabricated panels hitherto not known before and allows the same panel to be used in a variety of situations.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

The invention claimed is:

1. A prefabricated building panel comprising a foam body having one or more apertures, upper and lower end walls, side end walls, one or more channels in the upper and lower end walls to locate about top and bottom track members, and a plurality of slots or a channel or a protrusion formed in each side end wall , a surface portion adjacent each of the side end walls on one or both sides of the foam body being chamfered;

one or more structural members each of which is positionable in one of the one or more apertures to provide structural integrity;

whereby in use the one or more structural members are positioned and substantially enclosed within the foam body to form the building panel, the building panel is locatable on the top and bottom track members and engageable with adjacent building panels by complementary or flush side end wall configurations and the chamfered surface portions on adjacent building panels allow a flush and continuous finish to be formed when the panels are joined, wherein in use adjacent corner building panels each have a mitered longitudinal side edge and two C-shaped structural members are joined so that outward extending flanges of the C-shaped structural members are locatable in adjacent corner building panels so that the corner panels are joined to form a structural corner.

2. A prefabricated building panel as claimed in claim 1, wherein the foam body is a polystyrene foam wafer with fire retardant properties.

3. A prefabricated building panel as claimed in claim 1, wherein the panel has an internal face and an outside face, and further comprising a liner board layer on the internal face and a cement layer rendered on the outside face.

4. A prefabricated building panel as claimed in claim 3, wherein both the internal face and the outside face have chamfered longitudinal side edges.

5. A prefabricated building panel as claimed in claim 4, wherein the chamfered longitudinal side edges enable a plaster finish for the internal face and a cement render finish for the outside face of the panel so to provide a continuous finish with adjacent building panels.

6. A prefabricated building panel as claimed in claim 1, wherein the one or more apertures extend between the upper and lower end walls of the foam body.

7. A prefabricated building panel as claimed in claim 6, wherein at least one of the apertures extends partway or fully across the width of the foam body.

8. A prefabricated building panel as claimed in claim 1, further comprising additional access apertures or grooves in the apertures for electrical wiring and plumbing pipes and connections.

9. A prefabricated building panel as claimed in claim 1, wherein the number of structural members positioned within a panel varies depending on the load forces in which the panel will be subjected.

10. A prefabricated building panel as claimed in claim 1, wherein the structural members are studs or studs and noggins.

11. A prefabricated building panel as claimed in claim 1, wherein the structural members are made of metal or wood.

12. A prefabricated building panel as claimed in claim 1, wherein the structural members are studs made of metal U or Z sections.

13. A prefabricated building panel as claimed in claim 1, wherein one side end wall has a channel and a complementary protrusion extends from the other side end wall thereby enabling two panels to join when the protrusion of one panel fits within the channel of an adjacent panel.

14. A prefabricated building panel as claimed in claim 1, wherein the panel has a channel in both side end walls and a stud or joiner member can fit within the channels of adjacent panels and thereby enable the adjacent panels to be joined and substantially abut each other.

15. A prefabricated building panel as claimed in claim 1, wherein one or more channels in the upper and lower end walls enables locating the panel with the respective track members.

16. A prefabricated building panel as claimed in claim 1, wherein the one or more channels in the upper end wall are similar to the one or more channels in the lower end wall enabling the panel to be located in an upright or inverted position.

17. A prefabricated building panel as claimed in claim 1, wherein each mitered end wall is angled at substantially 45 degrees.

18. A panel building system including a frame with bottom track members, a plurality of panels as claimed claim 1, a plurality of structural members for positioning in the panels during construction, and top track members.

19. A method of construction using the panels claimed in claim 1, said method including steps of:

locating bottom track members on a base;

positioning one or more panels over the bottom track members;

joining adjacent panels;

positioning one or more structural members within each of the panels to provide suitable structural integrity; and locating top track members with the panel so that the top track member is substantially covered.

* * * * *